US008314573B2

(12) United States Patent
Ichikawa et al.

(10) Patent No.: US 8,314,573 B2
(45) Date of Patent: Nov. 20, 2012

(54) DISCHARGE LAMP LIGHTING CIRCUIT

(75) Inventors: Tomoyuki Ichikawa, Shizuoka (JP); Kazuki Saito, Shizuoka (JP); Masayasu Ito, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 310 days.

(21) Appl. No.: 12/608,089

(22) Filed: Oct. 29, 2009

(65) Prior Publication Data

US 2010/0109573 A1 May 6, 2010

(30) Foreign Application Priority Data

Oct. 30, 2008 (JP) ..... 2008-279769
Feb. 2, 2009 (JP) ..... 2009-021797

(51) Int. Cl.
*H05B 37/02* (2006.01)

(52) U.S. Cl. ..... 315/308; 315/82; 315/224

(58) Field of Classification Search ..... 315/209 R, 315/224–226, 291, 307–308, 77, 82
See application file for complete search history.

(56) References Cited

U.S. PATENT DOCUMENTS 4,134,043 A 1/1979 Nuver
4,346,332 A * 8/1982 Walden ..... 315/307
4,594,531 A * 6/1986 Ganser et al. ..... 315/307
5,212,428 A 5/1993 Sasaki et al.
5,349,268 A 9/1994 Nagai et al.
5,410,221 A * 4/1995 Mattas et al. ..... 315/307
5,463,281 A 10/1995 Linssen
5,485,061 A * 1/1996 Ukita et al. ..... 315/307
6,057,650 A 5/2000 Betz et al.
6,967,449 B2 * 11/2005 Ishihara et al. ..... 315/307
7,141,937 B2 11/2006 Kumagai et al.
7,518,318 B2 * 4/2009 Van Casteren ..... 315/291
2002/0047644 A1 4/2002 Ito et al.
2004/0113567 A1 6/2004 Yamauchi et al.
2005/0264237 A1 12/2005 Ishizuka
2006/0208664 A1 9/2006 Okishima
2007/0164687 A1 7/2007 Watanabe et al.
2007/0285030 A1 * 12/2007 Okamoto et al. ..... 315/247
2008/0106220 A1 * 5/2008 Urakabe et al. ..... 315/308
2009/0224682 A1 9/2009 Muramatsu

FOREIGN PATENT DOCUMENTS

EP 0 337 022 A1 10/1989
(Continued)

OTHER PUBLICATIONS

Office action in U.S. Appl. No. 12/398,279 (dated Jun. 24, 2011).

*Primary Examiner* — Tung X Le
(74) *Attorney, Agent, or Firm* — Fish & Richardson P.C.

(57) ABSTRACT

A discharge lamp lighting circuit facilitates carrying out re-ignition and addresses a problem than can arise due to an influence of a capacitor in an auxiliary lighting circuit. A driving voltage generating portion supplies an AC driving voltage to a discharge lamp to be a driving target. An auxiliary lighting circuit is provided on a terminal side of the discharge lamp. An auxiliary lighting capacitor, an auxiliary lighting resistor and a switch are provided in series between the terminal of the discharge lamp and a fixed voltage terminal. A control circuit controls a conducting state of the switch. The switch is brought into an ON state before the discharge lamp is turned ON, and is brought into an OFF state after the discharge lamp is turned ON.

8 Claims, 6 Drawing Sheets

FOREIGN PATENT DOCUMENTS

| | | | |
|---|---|---|---|
| GB | 498107 | | 3/1939 |
| GB | 1 496 918 | A | 1/1978 |
| JP | 04-141988 | | 5/1992 |
| JP | 06-124790 | | 5/1994 |
| JP | 11-329777 | | 11/1999 |
| JP | 2005-322500 | A | 11/2005 |

* cited by examiner

DISCHARGE LAMP LIGHTING CIRCUIT

TECHNICAL FIELD

The present disclosure relates to a discharge lamp lighting circuit.

BACKGROUND

In recent years, a metal halide lamp (which will be hereinafter referred to as a discharge lamp) is utilized as a lighting device for a vehicle (a headlamp) in place of a conventional halogen lamp having a filament. The discharge lamp has a higher light emission efficiency and a longer lifetime as compared with the halogen lamp. However, the discharge lamp requires a driving voltage of several tens to several hundreds V. For this reason, the discharge lamp cannot be directly driven by an on-vehicle battery of 12 V (or 24 V) so that a discharge lamp lighting circuit (which is also referred to as a ballast) is required.

A method of turning ON the discharge lamp is classified into DC driving and high frequency driving. When the DC driving is carried out, however, a discharge arc is asymmetrical so that the light emitting profile is not uniform. For this reason, the method is not suitable for a utilization as the lighting device for a vehicle, and AC driving is generally carried out in the lighting device for a vehicle. When the discharge lamp is subjected to the AC driving at a high frequency of 10 kHz or more, a phenomenon occurs in which an air current in a discharge tube and a lighting frequency are resonated (which is referred to as an acoustic resonance). As a result, the discharge arc is unstable. In order to eliminate disadvantages of both the DC driving and the high frequency AC driving, a method of carrying out driving at a low frequency of 10 kHz or less (a low frequency driving method) is a mainstream at present.

The discharge lamp lighting circuit includes a DC/DC converter for raising a battery voltage, a switching circuit such as an H bridge circuit for AC converting an output voltage of the DC/DC converter, an auxiliary lighting circuit and a starter circuit (for example, see Japanese Patent Document JP-A-11-329777).

As disclosed in FIG. 1 of JP-A-11-329777, the auxiliary lighting circuit (which is also referred to as a takeover circuit) is provided in parallel with an output smoothing capacitor of the DC/DC converter and is constituted by an auxiliary lighting capacitor and an auxiliary lighting resistor which are connected in series. At a start of a lighting operation of the discharge lamp, the following sequences are executed.

1. Power ON

2. Breakdown

The DC/DC converter is operated to raise a battery voltage up to approximately 400 volts (V). The voltage of 400 V is further raised to be 20 kV or more by the starter circuit to generate a high voltage pulse and the discharge lamp is broken down to start a discharge.

3. Arc Growth

Immediately after the breakdown, an overcurrent of several amps (A) is supplied to the discharge lamp by using an energy which is pre-stored in the output smoothing capacitor of the DC/DC converter and the capacitor of the auxiliary lighting circuit. Thus, a lighting failure is prevented and, at the same time, a transition from a glow discharge to an arc discharge is carried out.

4. Run-up

When the arc discharge is started, a light output of the discharge lamp is raised. The rise in the light output is determined by standards. In order to obtain a light output (a power) matched with the standards, the discharge lamp lighting circuit monitors a lamp current flowing to the discharge lamp, and a lamp voltage applied to the discharge lamp and regulates a duty ratio of ON/OFF of a switching unit in the DC/DC converter through a feedback. For a run-up period, a higher overpower than a rated power is temporarily supplied to the discharge lamp.

5. Stationary Lighting

Then, the power to be supplied to the discharge lamp is stabilized to have a rated value so that the light output of the discharge lamp is stabilized.

The auxiliary lighting capacitor of the auxiliary lighting circuit serves to store an energy (an electric charge) to be supplied to the discharge lamp in an arc growth. If a capacitance value of the auxiliary lighting circuit is increased significantly, the discharge lamp is turned ON more easily. On the other hand, if the capacitance value of the auxiliary lighting circuit is increased, the following problem is caused in stationary lighting.

More specifically, when the discharge lamp is subjected to AC driving, a direction (polarity) of the lamp current is inverted at a lighting frequency. In a polarity inversion timing, however, the discharge lamp is turned OFF in a moment. In a polarity switching timing, a transient voltage is applied to the discharge lamp by a back electromotive force generated in a high voltage coil (a part of the starter circuit) provided in series to the discharge lamp. Thus, a stable current is caused to flow after the polarity switching (which will be hereinafter referred to as a re-ignition).

When the capacitance value of the auxiliary lighting capacitor is increased, however, the back electromotive force generated by the high voltage coil in the re-ignition is absorbed into the auxiliary lighting capacitor. For this reason, there is a possibility that the re-ignition will be difficult to perform and the discharge lamp might cause a lighting failure. When the capacitance value of the auxiliary lighting capacitor is reduced to prevent the lighting failure, there is a possibility that a transition to the arc discharge will be hindered. Similarly, the problem might be caused in the case in which a resistance value of the auxiliary lighting resistor is small in addition to the case in which the capacitance value of the auxiliary lighting capacitor is great. Furthermore, the problem might be caused also in other discharge lamp lighting circuits in addition to the vehicle discharge lamp lighting circuit.

SUMMARY

In view of the foregoing circumstances, the disclosure describes a discharge lamp lighting circuit which can prevent a lighting failure in a re-ignition.

An exemplary embodiment of the present invention relates to a discharge lamp lighting circuit that includes:

a driving voltage generating portion for supplying an AC driving voltage to a discharge lamp to be a driving target; and an auxiliary lighting circuit on one of terminal sides of the discharge lamp.

The auxiliary lighting circuit can include:

- a capacitor, a switch unit and a resistance element provided in series between the terminal of the discharge lamp and a fixed voltage terminal; and
- a control portion for controlling a conducting state of the switch unit.

In some implementations, the switch unit is turned ON so that the auxiliary lighting circuit can effectively function, and growth from a glow discharge to an arc discharge can be promoted before the discharge lamp is turned ON. The switch unit is turned OFF so that the capacitor and the resistor in the auxiliary lighting circuit are disconnected from a driving path of the discharge lamp after the discharge lamp is turned ON. Therefore, it is possible to prevent a lighting failure in a re-ignition.

The "resistance element" includes a resistance element provided clearly and, furthermore, a parasitic resistance component of a wiring and an ON resistance of a switch unit, and a series parasitic resistor of a capacitor.

The auxiliary lighting circuit further can include a diode in parallel with the switch unit in such a direction that an anode thereof is set onto a side of either of the terminal and the fixed voltage terminal which has a lower electric potential.

According to some implementations, a large current from the auxiliary lighting circuit to the discharge lamp for an arc growth period can be supplied through the diode. Therefore, it is possible to use a switch unit having a small maximum rated current, thereby reducing a cost and decreasing an area.

The control portion can turn ON the switch unit when a lamp current flowing to the discharge lamp is smaller than a predetermined threshold current, and can turn OFF the switch unit when the lamp current is larger than the threshold current.

According to some implementations, by monitoring the lamp current, it is possible to detect whether the discharge lamp is turned ON or not, thereby controlling the switch unit properly.

The control portion can turn ON the switch unit when a lamp voltage to be applied to the terminal of the discharge lamp is higher than a predetermined threshold voltage, and can turn OFF the switch unit when the lamp voltage is lower than the threshold voltage According to some implementations, by monitoring the lamp voltage, it is possible to detect whether the discharge lamp is turned ON or not, thereby controlling the switch unit properly.

The control portion can turn ON the switch unit before a passage of a predetermined time since a start of a driving operation of the discharge lamp and can turn OFF the switch unit after the passage of the predetermined time.

A time waveform of a light output of the discharge lamp is determined based on standards. By monitoring a time, therefore, it is possible to estimate whether the discharge lamp is turned ON or not, thereby controlling the switch unit properly.

In some implementations, the driving voltage generating portion includes:

a first DC/DC converter for supplying a first driving voltage to the terminal of the discharge lamp;

a second DC/DC converter for supplying a second driving voltage to the other terminal of the discharge lamp;

a first switch provided on the terminal side of the discharge lamp and serving to electrically conduct the terminal of the discharge lamp and the fixed voltage terminal in an ON state; and a second switch provided on the other terminal side of the discharge lamp and serving to electrically conduct the other terminal of the discharge lamp and the fixed voltage terminal in an ON state. The first DC/DC converter and the second DC/DC converter may complementarily repeat an active state and a non-active state in a predetermined cycle, the first switch may be turned ON when the second DC/DC converter is active, and the second switch may be turned ON when the first DC/DC converter is active.

According to some implementations, respective output voltages of the first DC/DC converter and the second DC/DC converter complementarily repeat a high level (a raised voltage) and a ground voltage (0 V) in a predetermined lighting cycle. When the capacitor of the auxiliary lighting circuit is always connected, accordingly, the capacitor of the auxiliary lighting circuit repeats charging/discharging operations every cycle in addition to an output smoothing capacitor of the DC/DC converter. Consequently, the capacitor of the auxiliary lighting circuit is deteriorated earlier or a delay occurs in the transition of the output voltage of the DC/DC converter so that the discharge lamp is apt to cause a lighting failure. In the circuit topology, the switch unit is provided in the auxiliary lighting circuit so that the deterioration in the capacitor can be suppressed or the lighting failure can be prevented. Moreover, the capacitor of the auxiliary lighting circuit having a large capacity repeats the charging/discharging operations in a large current every lighting cycle. For this reason, a large power loss (a heat generation) is caused by the resistance component of the charging/discharging path. According to this aspect, however, it is possible to reduce the power loss.

The driving voltage generating portion can include, for example:

a first DC/DC converter for supplying a first driving voltage to one of the terminals of the discharge lamp;

a second DC/DC converter for supplying a second driving voltage to the other terminal of the discharge lamp;

a first switch provided on one of the terminal sides of the discharge lamp and serving to electrically conduct one of the terminals of the discharge lamp and the fixed voltage terminal in an ON state;

a second switch provided on the other terminal side of the discharge lamp and serving to electrically conduct the other terminal of the discharge lamp and the fixed voltage terminal; and at least one current detecting resistor provided on a path of a current flowing to the discharge lamp when the first switch is ON and a path of a current flowing to the discharge lamp when the second switch is ON.

The first DC/DC converter and the second DC/DC converter can complementarily repeat an active state and a non-active state at a predetermined frequency, the first switch can be turned ON when the second DC/DC converter is active, the second switch can be turned ON when the first DC/DC converter is active, and the first DC/DC converter and the second DC/DC converter can be controlled based on a voltage drop of the at least one current detecting resistor. The at least one current detecting resistor can be disposed in a place which is not included in a loop formed by the first switch and the diode.

According to some implementations, a current does not flow from the lighting auxiliary capacitor to the current detecting resistor in the grounding of the second DC/DC converter. Therefore, it is possible to reliably detect the grounding of the second DC/DC converter.

A terminal on the fixed voltage terminal side of the first switch and a terminal on the fixed voltage terminal side of the second switch can be connected in common. The current detecting resistor can be provided between the terminals of the first switch and the second switch which are connected in common and the fixed voltage terminal. The anode of the diode can be connected to a path connecting the first switch and the current detecting resistor.

The current detecting resistor can be provided between a terminal on the fixed voltage terminal side of the first switch and a terminal on the fixed voltage terminal side of the second switch. The anode of the diode can be connected to a path connecting the first switch and the current detecting resistor.

Two current detecting resistors can be provided for the at least one current detecting resistor. A first one of the current detecting resistors can be provided between the first switch and the fixed voltage terminal. A second one of the current detecting resistors can be provided between the second switch and the fixed voltage terminal. The anode of the diode may be connected to a path connecting the first switch and the first current detecting resistor.

Various advantages are present in some implementations. For example, it can be possible to prevent a lighting failure in a re-ignition of a discharge lamp and/or to reduce a power loss.

BEST MODE FOR CARRYING OUT THE INVENTION

Figure 1:
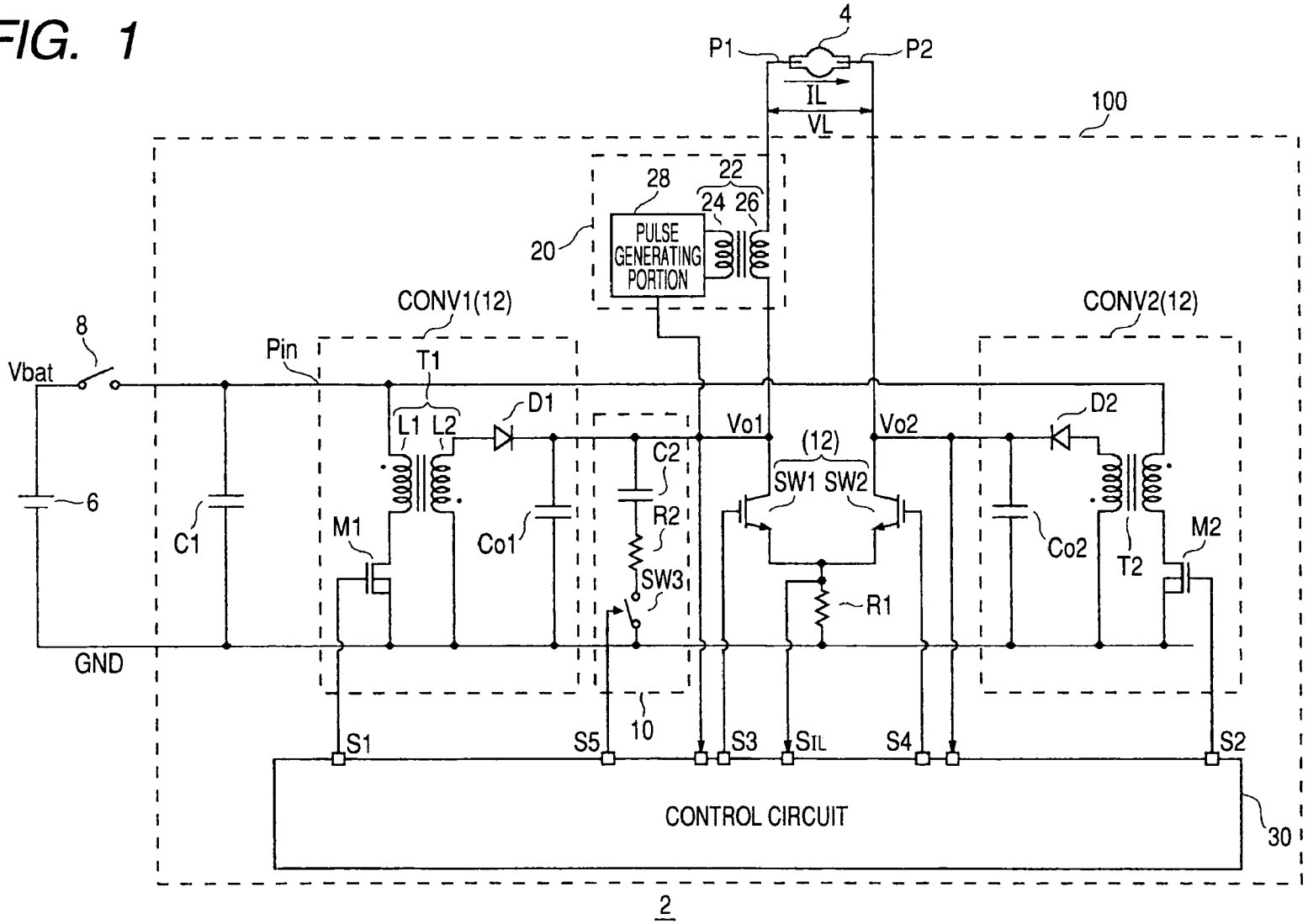
FIG. 1 is a circuit diagram showing an example of a structure of a lighting device for a vehicle according to a first embodiment.

The invention is described below with reference to the drawings. Identical or equivalent components, members and processes shown in each of the drawings have the same reference numerals and repetitive description will, therefore, be omitted. Moreover, the embodiments do not restrict the invention, but are illustrative, and all of features and combinations thereof described in the embodiments are not always essential to the invention.

In the specification, "a state in which a member A is connected to a member B" includes the case in which the members A and B are connected physically and directly, and furthermore, the case in which the members A and B are connected indirectly through another member which does not influence an electrical connecting state. Similarly, "a state in which a member C is provided between the members A and B" includes the case in which the members A and C or the members B and C are directly connected to each other", and furthermore, the case in which "they are connected indirectly through another member which does not influence an electrical connecting state.

First Embodiment

FIG. 1 is a circuit diagram showing a structure of a lighting device 2 for a vehicle according to a first embodiment. The lighting device 2 includes a discharge lamp 4 to be a metal halide lamp, a discharge lamp lighting circuit 100 for driving the discharge lamp 4, an on-vehicle battery (which will be hereinafter referred to as a battery) 6, and a power switch 8.

The battery 6 generates a DC voltage Vbat of 12 V (or 24 V). The power switch 8 is a relay switch provided to control ON/OFF operations of the discharge lamp 4 and is provided in series to the battery 6.

The discharge lamp lighting circuit 100 raises the smoothed battery voltage Vbat, and carries out an AC conversion, and supplies a voltage thus obtained to the discharge lamp 4. A detailed structure of the discharge lamp lighting circuit 100 is described below.

The discharge lamp lighting circuit 100 includes a first DC/DC converter CONV1, a second DC/DC converter CONV2, an auxiliary lighting circuit 10, a starter circuit 20, a first switch SW1, a second switch SW2, a current detecting resistor R1, a control circuit 30, and an input capacitor C1.

The input capacitor C1 is provided in parallel with the battery 6 and smoothes the battery voltage Vbat. More specifically, the input capacitor C1 is provided in the vicinity of a first transformer T1 and a second transformer T2 and fulfills a function of smoothing a voltage with respect to switching operations of the first DC/DC converter CONV1 and the second DC/DC converter CONV2.

The control circuit 30 is a functional IC (Integrated Circuit) for controlling the whole discharge lamp lighting circuit 100 and serves to control an operation sequence of the discharge lamp lighting circuit 100 and to regulate a power to be supplied to the discharge lamp 4. The control circuit 30 executes the following sequences, thereby turning ON the discharge lamp 4 and stabilizing a light output thereof.

1. Power ON
2. Breakdown
3. Arc growth
4. Run-up
5. Stationary lighting

Each sequence is described below in detail.

The first DC/DC converter CONV1, the second DC/DC converter CONV2, the first switch SW1, the second switch SW2 and the control circuit 30 forma driving voltage generating portion 12 for generating a driving voltage (which is also referred to as a lamp voltage) VL for the discharge lamp 4. The driving voltage generating portion 12 supplies an AC driving voltage VL having a first frequency (a lighting frequency) f1 between both terminals of the discharge lamp 4. The first frequency f1 is set to be equal to or lower than 10 kHz, and more specifically, is set to be approximately 250 Hz to 750 Hz. An inverse number of the lighting frequency f1 is referred to as a lighting cycle T1 (=1/f1).

The first DC/DC converter CONV1 is an insulating type switching regulator and includes a first switching unit M1, the first transformer T1, a first rectifier diode D1 and a first output capacitor Co1. The topology of the first DC/DC converter CONV1 is general, and a brief description is given below.

A primary coil L1 of the first transformer T1 and the first switching unit M1 are provided in parallel with the input capacitor C1 and in series between an input terminal Pin of the first DC/DC converter CONV1 and a ground terminal (GND). For example, the first switching unit M1 is constituted by an N channel MOSFET. A secondary coil L2 of the first transformer T1 has one of terminals which is grounded and the other terminal which is connected to an anode of the first rectifier diode D1. The first output capacitor Co1 is provided between a cathode of the first rectifier diode D1 and a ground terminal.

A first control pulse signal S1 having a second frequency f2 which is higher than the first frequency f1 is applied to a control terminal (a gate) of the first switching unit M1. For example, the second frequency f2 can be 400 kHz. The first switching unit M1 is turned ON when the first control pulse signal S1 has a high level, and is turned OFF when the first control pulse signal S1 has a low level. As is described below, the control circuit 30 regulates a duty ratio of the high level of the first control pulse signal S1 to the low level thereof through a feedback based on an electrical state of the discharge lamp 4.

The first DC/DC converter CONV1 can be switched into an active state and a non-active state, and supplies a first driving voltage (which will be hereinafter referred to as an output voltage) Vo1 to a terminal P1 of the discharge lamp 4 in the active state.

The second DC/DC converter CONV2 has the same circuit topology as that of the first DC/DC converter CONV1. In other words, the first rectifier diode D1 and a second rectifier diode D2, the first output capacitor Co1 and a second output capacitor Co2, the first transformer T1 and the second transformer T2, and the first switching unit M1 and a second switching unit M2 correspond to each other. ON/OFF operations of the second switching unit M2 are controlled in response to a second control pulse signal S2 generated by the control circuit 30 through a feedback based on the electrical state of the discharge lamp 4.

The second DC/DC converter CONV2 also can be switched into an active state and a non-active state, and supplies a second driving voltage (which will be hereinafter referred to as a second output voltage) Vo2 to the other terminal P2 of the discharge lamp 4 in the active state.

The first switch SW1 is provided on the terminal P1 side of the discharge lamp 4 and electrically conducts the terminal P1 of the discharge lamp 4 and a fixed voltage terminal (a ground terminal) in an ON state. The second switch SW2 is provided on the other terminal P2 side of the discharge lamp 4 and electrically conducts the other terminal P2 of the discharge lamp 4 and the ground terminal in an ON state. Although an IGBT (Insulated Gate Bipolar Transistor) or an MOSFET (Metal Oxide Semiconductor Field Effect Transistor) are suitable for the first switch SW1 and the second switch SW2, other alternative devices may be used. The ON/OFF states of the first switch SW1 and the second switch SW2 are controlled in response to control signals S3 and S4 sent from the control circuit 30, respectively.

The first DC/DC converter CONV1 and the second DC/DC converter CONV2 complementarily repeat the active state and the non-active state in a predetermined cycle T1 (that is, the first frequency f1). In other words, a period for which the first DC/DC converter CONV1 is active and a period for which the second DC/DC converter CONV2 is active have a half of the lighting cycle T1, respectively. A state in which the first DC/DC converter CONV1 is active will be hereinafter referred to as a first state ϕ1 and a state in which the second DC/DC converter CONV2 is active will be hereinafter referred to as a second state ϕ2. The first switch SW1 is turned ON when the second DC/DC converter CONV2 is active, that is, in the second state ϕ2, and the second switch SW2 is turned ON when the first DC/DC converter CONV1 is active, that is, in the first state ϕ1.

In the first state ϕ1, the first driving voltage Vo1 is applied to the terminal P1 of the discharge lamp 4 and a ground voltage (0 V) is applied to the other terminal P2. As a result, the driving voltage VL (which is almost equal to Vo1) is applied in a first polarity to the discharge lamp 4. In the second state ϕ2, the second output voltage Vo1 is applied to the other terminal P2 of the discharge lamp 4 and the ground voltage is applied to the terminal P1. As a result, the driving voltage VL (which is almost equal to Vo2) is applied, to the discharge lamp 4, in a second polarity which is opposite to the first polarity.

For the run-up period and the stationary lighting period, the control circuit 30 alternately repeats the first state ϕ1 and the second state ϕ2 in the predetermined lighting cycle T1. As a result, the AC driving voltage VL is supplied to the discharge lamp 4.

The current detecting resistor R1 is provided on a path of a lamp current IL flowing to the discharge lamp 4. In the circuit of FIG. 1, the current detecting resistor R1 is provided between emitters of the first switch SW1 and the second switch SW2 which are connected in common, and a ground terminal. In the first state ϕ1, a lamp current having the first polarity (in a rightward direction of FIG. 1) flows to the discharge lamp 4. In the second state ϕ2, a lamp current having a second polarity (in a leftward direction of FIG. 1) flows to the discharge lamp 4. In each of the first and second states ϕ1 and ϕ2, a voltage drop (hereinafter referred to as a current detecting signal $S_{IL}$) which is proportional to the lamp current IL is generated in the current detecting resistor R1. The current detecting signal $S_{IL}$ is fed back to the control circuit 30.

The starter circuit 20 is provided for breaking down the discharge lamp 4 and includes a starter transformer 22 and a pulse generating portion 28. The pulse generating portion 28 of the starter circuit 20 applies a pulse voltage having an amplitude of 400 V to a primary coil 24 of the starter transformer 22. As a result, a high voltage pulse (for example, 20 kV) corresponding to a winding ratio of the starter transformer 22 is generated in a secondary coil 26 side and is applied to the discharge lamp 4. As a result, the discharge lamp 4 is broken down so that a discharge is started.

The auxiliary lighting circuit 10 is provided for causing the discharge lamp 4 to carry out an arc growth. The auxiliary lighting circuit 10 includes an auxiliary lighting capacitor C2, an auxiliary lighting resistor R2 and a switch SW3.

The auxiliary lighting circuit 10 is provided between the terminal P1 of the discharge lamp 4 and the ground terminal, that is, in parallel with the first output capacitor Co1. The auxiliary lighting capacitor C2, the auxiliary lighting resistor R2 and the switch SW3 are connected in series. The order of the auxiliary lighting capacitor C2, the auxiliary lighting resistor R2 and the switch SW3 is not particularly restricted but may be changed properly. For the switch SW3, it is possible to utilize various transistor devices such as an MOSFET (Metal Oxide Semiconductor Field Effect Transistor), a bipolar transistor or an IGBT.

As an example, the auxiliary lighting capacitor C2 has a capacitance of 1.8 μF and the auxiliary lighting resistor R2 has a resistance of 180Ω. The auxiliary lighting resistor R2 does not need to be provided as a resistance unit but can be replaced with an ON-resistance of the switch SW3 depending on a resistance value thereof. ON/OFF operations of the switch SW3 are controlled in response to a control signal S5 sent from the control circuit 30. A control sequence of the switch SW3 is described below.

The structure of the discharge lamp lighting circuit 100 has been described above. Next, the operation is described in accordance with a sequence. FIGS. 2A to 2D are time charts showing an operating state of the discharge lamp lighting circuit 100. The ordinate axis and the abscissa axis in each of FIGS. 2A to 2D are enlarged or reduced to facilitate understanding, and each waveform illustrated therein is also simplified to facilitate understanding. FIGS. 2A to 2D show waveforms in a breakdown process, an arc growth process, a run-up process and stationary lighting, respectively.

1. Power ON

When a user turns ON the power switch 8, the discharge lamp lighting circuit 100 is activated. The control circuit 30 brings the first DC/DC converter CONV1 and the first switch SW1 into the active state and the OFF state respectively, and raises the battery voltage Vbat into a predetermined high voltage (400 V) to carry out a stabilization. More specifically, the control circuit 30 regulates the duty ratio of the first switching unit M1 by utilizing a PWM (Pulse Width Modulation) or a PFM (Pulse Frequency Modulation) method in such a manner that the output voltage Vo1 of the first DC/DC converter CONV1 is 400 V. For the PWM/PFM control, it is preferable to use a well-known technique. As an example, the PWM control can be implemented by an error amplifier for amplifying an error between the output voltage Vo1 and a reference voltage (Vref) and a comparator for slicing a periodic signal having a triangular wave or a sawtooth wave with an output of the error amplifier and generating the first control pulse signal S1. Alternatively, it is possible to convert the output voltage Vo1 into a digital signal by an A/D converter, thereby generating the first control pulse signal S1 through a microcomputer control. In other words, the control method of the first switching unit M1 is not limited to the foregoing techniques.

In the meantime, the control circuit 30 turns ON the switch SW3. As a result, the first output capacitor Co1 of the first DC/DC converter CONV1 and the auxiliary lighting capacitor C2 of the auxiliary lighting circuit 10 are charged with the voltage Vo1 (which is almost equal to 400 V) so that energy is stored.

2. Breakdown

Figure 2A:
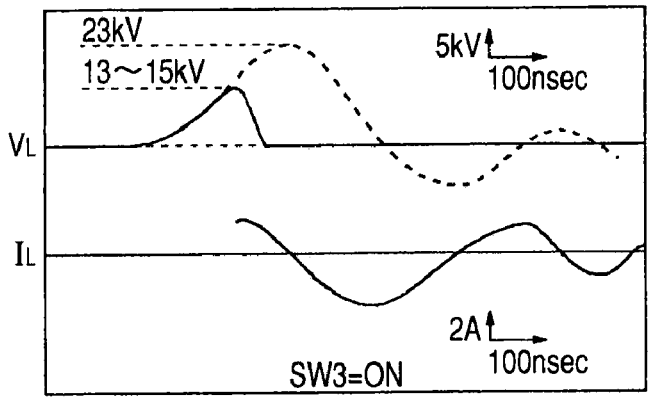
FIGS. 2A to 2D are time charts showing an operating state of a discharge lamp lighting circuit.

The starter circuit 20 receives the voltage Vo1 of 400 V generated by the first DC/DC converter CONV1. The pulse generating portion 28 applies a pulse having an amplitude of 400 V to the primary coil 24 of the starter transformer 22. As shown in FIG. 2A, a high voltage pulse of 20 kV or more is generated in the secondary coil 26 of the starter transformer 22. As a result, the driving voltage of the discharge lamp 4 is raised to approximately 13 to 15 kV to carry out a breakdown so that a glow discharge is started.

3. Arc Growth

Figure 2B:
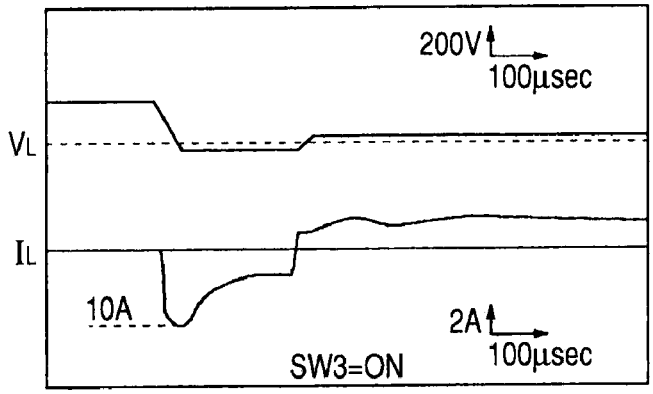
Figure 2C:
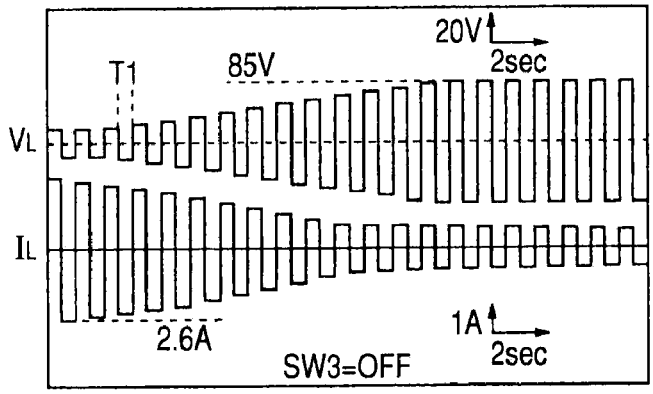

In the arc growth process, the control circuit 30 continuously maintains the ON state of the switch SW3. When the discharge lamp 4 is broken down, a large current of several A (more specifically, approximately 10 A) is supplied from the first output capacitor Co1 and the auxiliary lighting capacitor C2 to the discharge lamp 4. First of all, the current is supplied from the first output capacitor Co1 to the discharge lamp 4. Then, a current delayed corresponding to a time constant formed by the auxiliary lighting resistor R2 and the auxiliary lighting capacitor C2 is supplied from the auxiliary lighting capacitor C2 to the discharge lamp 4. Supply of the large current to the discharge lamp 4 is taken over from the first output capacitor Co1 to the auxiliary lighting circuit 10. Therefore, the auxiliary lighting circuit 10 is also referred to as a takeover circuit. Through the process, a lighting failure is prevented, and furthermore, a transition from the glow discharge to the arc discharge is carried out (FIG. 2B).

4. Run-up

When the arc growth process is ended so that the arc discharge is stabilized, the control circuit 30 turns OFF the switch SW3 and controls the first DC/DC converter CONV1, the second DC/DC converter CONV2, the first switch SW1 and the second switch SW2, thereby repeating the first state $\phi 1$ and the second state $\phi 2$ complementarily in the predetermined cycle T1.

With a growth of the arc discharge, the light output of the discharge lamp 4 is raised. The rise in the light output is determined based on standards. In order to obtain a light output (a power) matched with the standards, the control circuit 30 monitors the first driving voltage Vo1, the second driving voltage Vo2 and the lamp current IL and regulates the duty ratio of the ON/OFF operations of the first switching unit M1 and the second switching unit M2 through a feedback. In order to rapidly raise the light output of the discharge lamp 4 for a run-up period, the discharge lamp lighting circuit 100 temporarily supplies a higher overpower than a rated power and then stabilizes the lamp voltage and the lamp current IL into 85 V and 0.4 A to carry out an approximation to the rated power (35 watts (W)).

Taking note of a control of the conducting state of the switch SW3, the switch SW3 is turned ON before the discharge lamp 4 is turned ON, and is turned OFF after the discharge lamp 4 is turned ON. Description will be given to a switching control of the switch SW3 from ON to OFF which is carried out by the control circuit 30. The control of the switch SW3 can be executed in accordance with any of the following methods 1 to 3.

Method 1

The control circuit 30 controls the ON/OFF operations of the switch SW3 based on the lamp current IL flowing to the discharge lamp 4. More specifically, the current detecting signal $S_{IL}$ corresponding to the lamp current IL is compared with a threshold signal corresponding to a predetermined threshold current Ith (for example, 0.2 A). When it is estimated that IL<Ith is set, that is, the discharge lamp 4 is turned OFF, the switch SW3 is turned ON. When it is estimated that IL>Ith is set, that is, the discharge lamp 4 is turned ON, the switch SW3 is turned OFF.

Method 2

The control circuit 30 controls the ON/OFF operations of the switch SW3 based on the driving voltage Vo1 (or Vo1) supplied to the discharge lamp 4. More specifically, the driving voltage Vo1 is compared with a predetermined threshold voltage Vth (for example, 250 V). When it is estimated that Vo1>Vth is set, that is, the discharge lamp 4 is turned OFF, the switch SW3 is turned ON. When it is estimated that Vo1<Vth is set, that is, the discharge lamp 4 is turned ON, the switch SW3 is turned OFF.

Method 3

The time required from start of the driving operation of the discharge lamp 4 to ON operation of the discharge lamp 4 can be anticipated based on a type of the discharge lamp 4 and characteristics of the first DC/DC converter CONV1, the second DC/DC converter CONV2 and the auxiliary lighting circuit 10. Therefore, the control circuit 30 controls the ON/OFF operations of the switch SW3 based on a timer control. More specifically, a time passing after the start of the driving operation of the discharge lamp 4 (for example, since the ON operation of the power switch 8) is begun to turn ON the switch SW3 before passage of a predetermined amount of time and to turn OFF the switch SW3 after the passage of the predetermined time.

5. Stationary Lighting

Figure 2D:
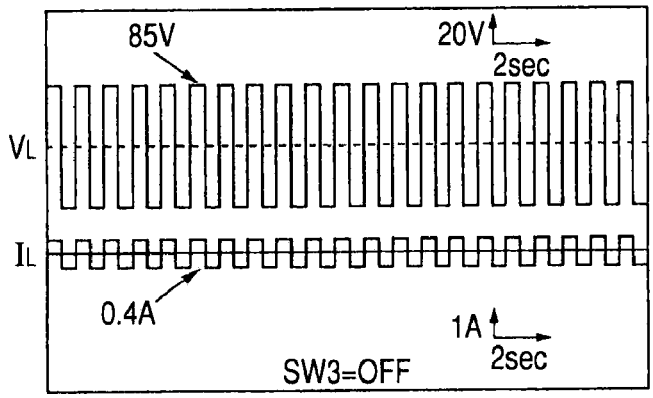

Through the run-up process, the power to be supplied to the discharge lamp 4 is stabilized to have a rated value of 35 W so that the light output of the discharge lamp 4 is stabilized (FIG. 2D).

The operation of the discharge lamp lighting circuit 100 according to the embodiment has been described above. The discharge lamp lighting circuit 100 can provide the following advantages compared with the conventional discharge lamp lighting circuit.

(1) In the conventional circuit, the auxiliary lighting capacitor C2 is always connected to the driving path of the discharge lamp 4. Therefore, a back electromotive force induced by the secondary coil 26 in the re-ignition of the discharge lamp 4 is absorbed into the auxiliary lighting capacitor C2 so that the re-ignition is hard to perform. On the other hand, in the embodiment, the switch SW3 of the auxiliary lighting circuit 10 is provided in series to the auxiliary lighting capacitor C2 and is turned OFF after the discharge lamp 4 is turned ON. In other words, the auxiliary lighting capacitor C2 and the auxiliary lighting resistor R2 are disconnected from the output terminal of the first DC/DC converter CONV1, that is, the driving path of the discharge lamp 4. Consequently, it is possible to eliminate an influence on the re-ignition and to prevent the discharge lamp 4 from causing a lighting failure. Moreover, it is possible to enhance a symmetric property of the electrical states on the both terminal P1 and P2 sides of the discharge lamp 4. Therefore, it is also possible to improve a symmetric property of a discharge profile of the discharge lamp 4.

(2) In case of the conventional circuit structure in which the switch SW3 is not provided in the auxiliary lighting circuit 10 shown in FIG. 1, moreover, the charging/discharging operations of the auxiliary lighting capacitor C2 are repeated every lighting cycle when the discharge lamp 4 is subjected to AC lighting. For this reason, there is a problem in that the auxiliary lighting capacitor C2 and the auxiliary lighting resistor R2 generate a heat and a cost of a countermeasure taken against the heat generation is increased. In addition, there is a possibility that a lifetime of the auxiliary lighting capacitor C2 might be reduced due to a repetition of the charging/discharging operations in the conventional circuit. On the other hand, in the embodiment, the charging/discharging operations of the auxiliary lighting capacitor C2 are not carried out while the discharge lamp 4 is subjected to the AC lighting. Consequently, the heat generation of the auxiliary lighting capacitor C2 and the auxiliary lighting resistor R2 can be set to be substantially zero, and furthermore, the lifetime can be prolonged.

The advantage (2) is a peculiar effect to a topology (referred to as a double converter type) in which the two DC/DC converters shown in FIG. 1 are provided on the both terminals of the discharge lamp 4. In other words, the provision of the switch SW3 is very useful in a discharge lamp lighting circuit of the double converter type.

(3) In order to suppress an influence of the auxiliary lighting capacitor C2 on the lighting operation of the discharge lamp 4 in the conventional circuit, it is necessary to reduce the capacity of the auxiliary lighting capacitor C2. On the other hand, in the embodiment, the auxiliary lighting capacitor C2 does not influence the lighting operation of the discharge lamp 4. Therefore, the capacitance value can be designed in consideration of only an original function of the auxiliary lighting circuit 10. As compared with the conventional art, consequently, it is possible to utilize a capacitor having a larger capacity. Thus, it is possible to reliably carry out an arc growth.

The operation and effect of the discharge lamp lighting circuit 100 has been described above.

Figure 3A:
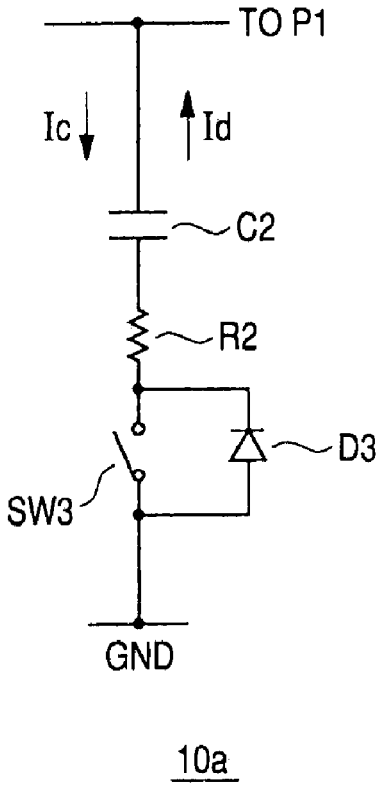
FIGS. 3A and 3B are circuit diagrams showing further examples of structures of auxiliary lighting circuits.
Figure 3B:
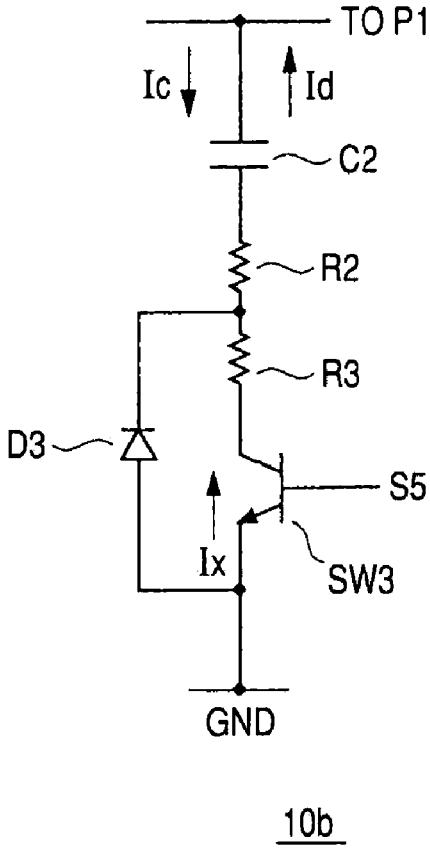

Next, a description is provided for a variant of the auxiliary lighting circuit 10. FIGS. 3A and 3B are circuit diagrams showing structures of auxiliary lighting circuits 10*a* and 10*b* according to the variant.

The auxiliary lighting circuit 10*a* in FIG. 3A further includes a diode D3 in addition to the auxiliary lighting circuit 10 in FIG. 1. The diode D3 is disposed in parallel with the switch SW3 in such a direction that an anode is provided on a side of either of the terminal P1 of the discharge lamp 4 and the ground terminal GND which has a lower electric potential. In the discharge lamp lighting circuit 100 of FIG. 1, the ground terminal GND has a lower electric potential than the terminal P1. Therefore, the anode of the diode D3 is provided on the ground terminal GND side.

In a lighting device for a vehicle, a time of approximately 30 milliseconds (ms) is required from the ON operation of the power switch 8 to the activation of the discharge lamp 4 (a generation of a pulse in the starter circuit 20). In other words, it is preferable that the charging operation of the auxiliary lighting capacitor C2 should be completed before a breakdown caused by the starter circuit 20. Although it is sufficient that a charging current Ic is approximately 0.1 A, therefore, the discharging current to be supplied to the discharge lamp 4 by the auxiliary lighting circuit 10 is large, that is, several A.

With the structure in FIG. 1, a discharging current Id passes through the switch SW3. For this reason, it is necessary to use a switch corresponding to the discharging current Id, and there is a room for an improvement in respect of a cost or a circuit area. According to the auxiliary lighting circuit 10*a* in FIG. 3A, the charging operation of the auxiliary lighting capacitor C2 is carried out through the switch SW3, and the discharging current Id is mainly supplied from the auxiliary lighting capacitor C2 to the discharge lamp 4 through the diode D3. Accordingly, it is sufficient that the switch SW3 is designed in consideration of a small charging current Ic of approximately 0.1 A. Therefore, it is possible to reduce the size and cost.

In the casein which the auxiliary lighting circuit 10*a* in FIG. 3A is used, the switch SW3 may be turned OFF for a period of an arc growth.

The auxiliary lighting circuit 10*b* in FIG. 3B further includes a discharging current limiting resistor R3 in addition to the structure in FIG. 3A. The discharging current limiting resistor R3 is provided in series to the switch SW3 between an anode and a cathode in the diode D3. The switch SW3 can be constituted by a bipolar transistor of an NPN type. For example, R2=180Ω and R3=2.2 kΩ are set. By using the bipolar transistor in an active region, the auxiliary lighting resistor R2 can also be replaced with an ON resistance of a transistor. In place of the bipolar transistor, it is also possible to use an MOSFET or an IGBT.

According to the structure in FIG. 3B, the discharging current Id mainly flows to the diode D3 side in the same manner as in FIG. 3A. Therefore, it is possible to use a small bipolar transistor as the switch SW3.

In the case in which the bipolar transistor is used as the switch SW3 as shown in FIG. 3B, moreover, the discharging current Id tries to flow from an emitter of the bipolar transistor (SW3) to a collector thereof immediately after an activation of the discharge lamp 4. If the current is large, therefore, there is a possibility that the reliability of the switch SW3 will deteriorate.

When a voltage drop of the switch SW3 is set to be zero, that of the discharging current limiting resistor R3 is clamped with a forward voltage Vf (=0.7 V) of the diode D3. According to the auxiliary lighting circuit 10*b* in FIG. 3B, therefore, a discharging current Ix flowing to the discharge lamp 4 through the switch SW3 can be limited to be equal to or less than (Vf/R3).

The general discharge lamp lighting circuit 100 has a ground protecting function for deciding whether the both ends P1 and P2 of the discharge lamp 4 are grounded or not and executing a predetermined processing (a shutdown of a circuit or a temporary stoppage of an ON operation) when the grounding is generated. As shown in FIGS. 3A and 3B, in the case in which the lighting auxiliary circuit is provided with the diode D3 in a parallel path with the switch SW3, there is a possibility that a malfunction might be caused, that is, the ground cannot be detected accurately when the output of the second DC/DC converter CONV2 on an opposite side to the lighting auxiliary circuit 10 is grounded.

The malfunction is described by taking, as an example, a circuit in which the discharge lamp lighting circuit 100 in FIG. 1 and the lighting auxiliary circuit 10*b* in FIG. 3B are combined.

The discharge lamp lighting circuit 100 is turned ON. Subsequently, a transition to a breakdown process and an arc growth process is sequentially carried out. In the arc growth process, an electric charge of the lighting auxiliary capacitor C2 is supplied to the discharge lamp 4. The switch SW3 which is turned ON at first is turned OFF with a start of a lighting operation. At this time, an electric charge corresponding to the output voltage Vo1 remains in the lighting auxiliary capacitor C2.

Then, there is started AC lighting in which the first DC/DC converter CONV1 and the second DC/DC converter CONV2 are alternately made active at a lighting frequency. Alternatively, a warm-up is carried out in a certain time before the start of the AC lighting (which is also referred to as a DC period) in some cases. In other words, the second DC/DC converter CONV2 is fixedly made active and the first switch SW1 is fixedly turned ON so that DC lighting is carried out. By performing the warm-up, it is possible to evenly warm electrodes on the both terminals of the discharge lamp 4.

Immediately after the start of the AC lighting or in switching of a polarity in the warm-up (DC period), a transition from the first state $\phi$1 to the second state $\phi$2 is generated.

In the transition from the first state $\phi$1 to the second state $\phi$2, when the first switch SW1 is turned ON, the electric charge remaining in the lighting auxiliary capacitor C2 flows toward the first switch SW1 and the current detecting resistor R1. More specifically, a current flows to a closed loop for a return from the grounding terminal GND in FIG. 3B to the grounding terminal GND through the diode D3, the lighting auxiliary resistor R2, the lighting auxiliary capacitor C2, the first switch SW1 and the current detecting resistor R1.

On the other hand, the control circuit 30 decides, as grounding, a state in which the terminal voltage of the discharge lamp 4 is low and the current does not flow to the discharge lamp 4. More specifically, the decision of the grounding state is made by meeting both of the following two conditions.

Condition 1: The electric potential of the terminal P1 (P2) of the discharge lamp 4 is lower than a predetermined threshold.

Condition 2: The voltage drop ($S_{IL}$) generated on the current detecting resistor R1 is smaller than a threshold.

It is assumed that the output of the second DC/DC converter CONV2 (that is, the terminal P2 of the discharge lamp 4) is grounded. At this time, the condition 1 is met. However, the current flows to the closed loop so that a non-zero voltage drop is generated in the current detecting resistor R1. Therefore, the lighting auxiliary circuit 10 decides that the condition 2 is not met. This implies that the grounding of the second DC/DC converter CONV2 cannot be detected. When a malfunction is caused in the detection of the grounding, control of the discharge lamp lighting circuit 100 is mismatched, which is not desirable.

A technique for eliminating the malfunction is described below.

In order to avoid the malfunction of the detection of the grounding, the current detecting resistor R1 is disposed in a place which is not included in a loop formed by the first switch SW1 and the diode D3. In other words, the current detecting resistor R1 is excluded from the loop. In other words, the anode terminal of the diode D3 is connected to a position in which a loop current flowing in the loop including the diode D3 itself and the first switch SW1 does not flow into the current detecting resistor R1.

Figure 4:
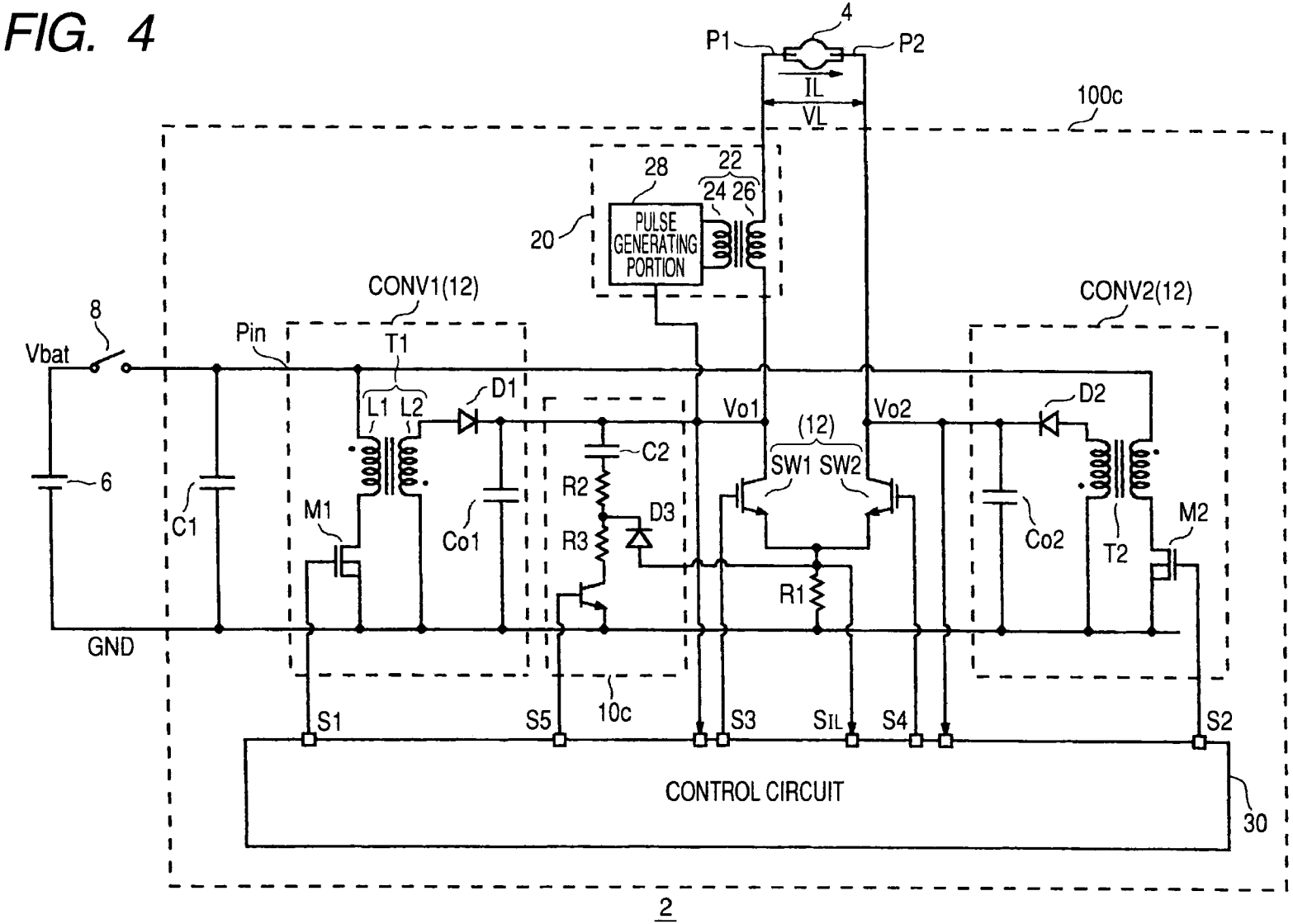
FIG. 4 is a circuit diagram showing an example of a structure of a discharge lamp lighting circuit 100*c* according to a first variant.

FIG. 4 is a circuit diagram showing a structure of a discharge lamp lighting circuit 100*c* according to a first variant. A control circuit 30 controls switching of a first DC/DC converter CONV1 and a second DC/DC converter CONV2 based on a voltage drop (a current detecting signal $S_{IL}$) generated in a current detecting resistor R1. Furthermore, the control circuit 30 detects grounding of an output of the first DC/DC converter CONV1 based on an electric potential Vo1 of an end P1 of a discharge lamp 4 and the current detecting signal $S_{IL}$, and detects grounding of an output of the second DC/DC converter CONV2 based on an electric potential Vo2 of the other end P2 of the discharge lamp 4 and the current detecting signal $S_{IL}$.

Although a lighting auxiliary circuit 10*c* has the same components as those of the lighting auxiliary circuit 10*b* shown in FIG. 3C, a connecting configuration of a diode D3 is varied. More specifically, the diode D3 has an anode connected to a node on a path connecting a first switch SW1 and the current detecting resistor R1. The other structures are the same.

Next, a description is provide for operation of the discharge lamp lighting circuit 100*c* in FIG. 4. There is assumed a state in which the second DC/DC converter CONV2 is grounded in a transition from a first state $\phi$1 to a second state $\phi$2. At this time, an electric charge remaining in a lighting auxiliary capacitor C2 flows into the first switch SW1. A current flowing into the first switch SW1 does not flow to the current detecting resistor R1 but the lighting auxiliary capacitor C2 through a second rectifying diode D2 again. In other words, a loop path is formed by the second rectifying diode D2, a lighting auxiliary resistor R2, the lighting auxiliary capacitor C2 and the first switch SW1, and the current detecting resistor R1 is excluded from the loop.

In other words, a voltage drop is not generated in the current detecting resistor R1. Therefore, the control circuit 30 can properly decide the condition 2 for the grounding decision and can detect that the second DC/DC converter CONV2 is set in a grounding state.

Figure 5A:
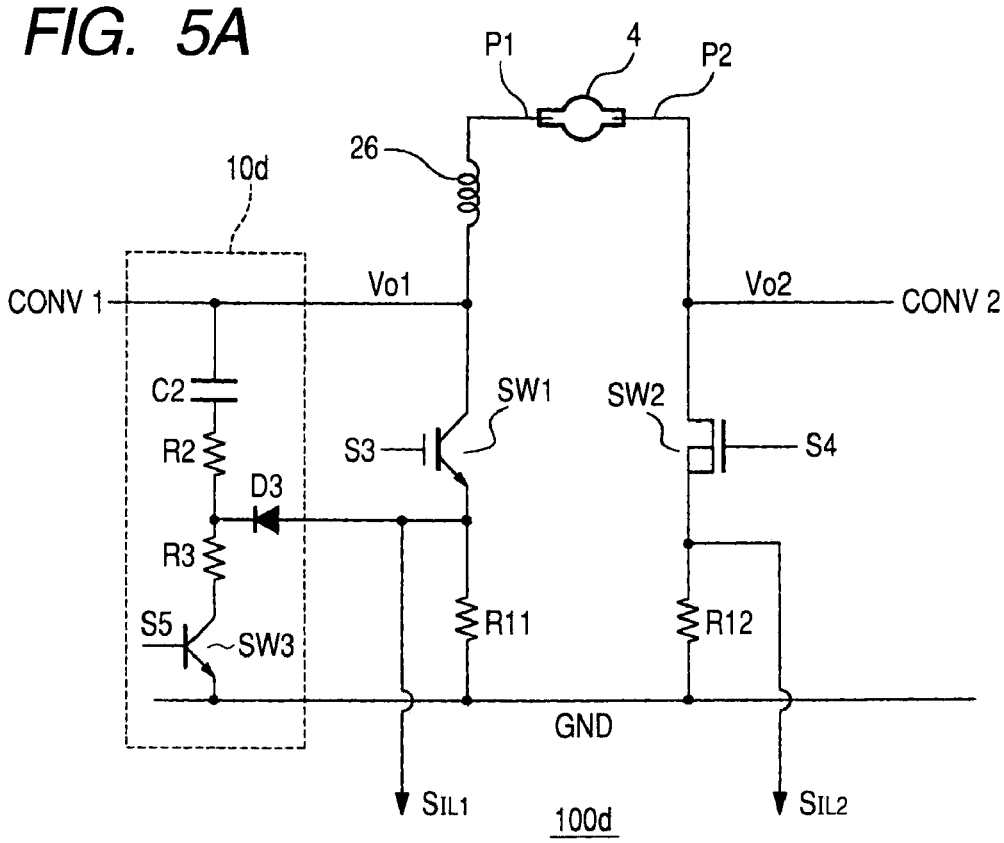
FIGS. 5A and 5B are circuit diagrams showing a part of structures of discharge lamp lighting circuits 100*d* and 100*e* according to second and third variants.
Figure 5B:
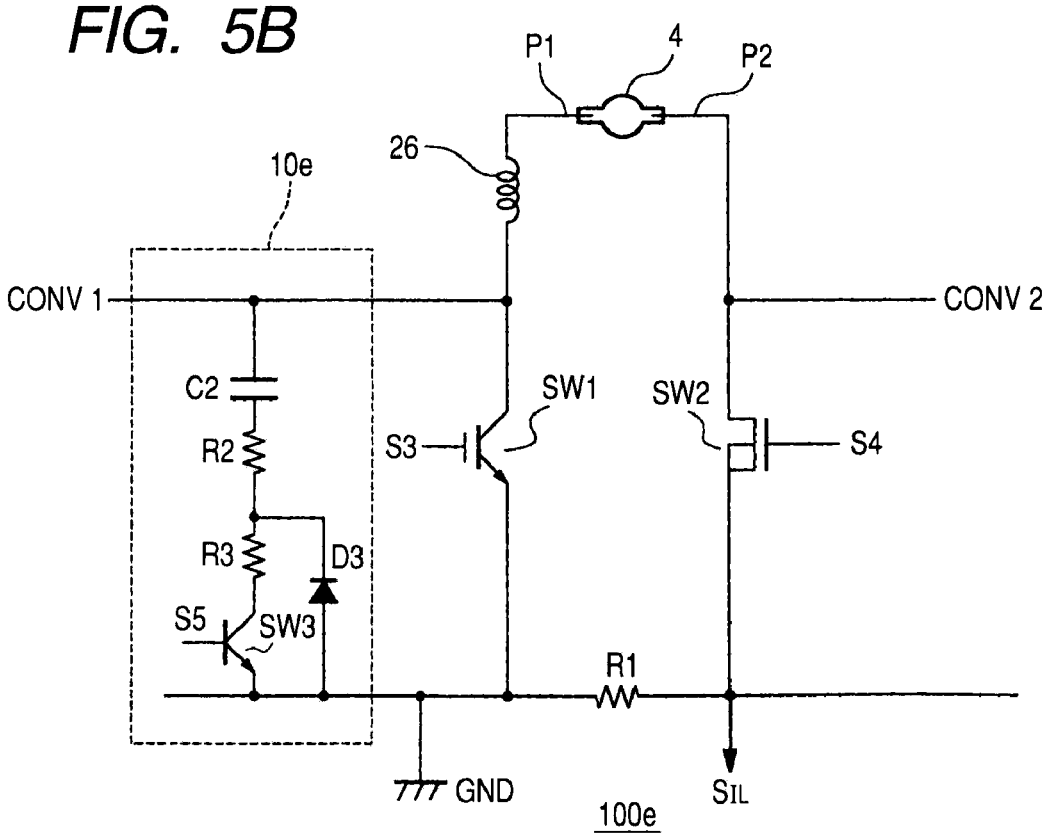

FIGS. 5A and 5B are circuit diagrams showing a part of structures of discharge lamp lighting circuits 100*d* and 100*e* according to second and third variants.

The discharge lamp lighting circuit 100*d* in FIG. 5A is provided with two current detecting resistors R11 and R12. The first current detecting resistor R11 is provided between a first switch SW1 and a fixed voltage terminal (a grounding terminal GND), and the second current detecting resistor R12 is provided between a second switch SW2 and the grounding terminal GND.

A voltage drop generated in the current detecting resistor R11 is fed back, to a control circuit 30 (not shown), as a current detecting signal $S_{IL1}$ indicative of a current flowing to a discharge lamp 4 in a second state $\phi$2. Similarly, a voltage drop generated in the current detecting resistor R12 is fed back, to the control circuit 30 (not shown), as a current detecting signal $S_{IL2}$ indicative of a current flowing to the discharge lamp 4 in a first state $\phi$1.

Reference is now made to the lighting auxiliary circuit 10*d* in FIG. 5A. All of the two current detecting resistors R11 and R12 are provided in positions which are not included in a loop formed by a diode D3 and the first switch SW1. More specifically, the diode D3 has a cathode connected to a node on a path connecting the first switch SW1 and the current detecting resistor R11.

Also in the structure of FIG. 5A, even if a current flows to a loop formed by the first switch SW1, the diode D3, a lighting auxiliary resistor R2 and a lighting auxiliary capacitor C2, a voltage drop is not generated in the current detecting resistor R11. Accordingly, it is possible to suitably detect grounding of a second DC/DC converter CONV2.

In the discharge lamp lighting circuit 100*e* of FIG. 5B, a current detecting resistor R1 is provided between a terminal on a fixing voltage terminal (a grounding terminal) side of a first switch SW1 and a terminal on a grounding terminal side of a second switch SW2. A terminal on the first switch SW1 side in the current detecting resistor R1 is grounded.

Also in FIG. 5B, the current detecting resistor R1 is provided in a position which is not included in a loop formed by the diode D3 and the first switch SW1. More specifically, the diode D3 has a cathode connected to a node on a path connecting the first switch SW1 and the current detecting resistor R1.

In FIG. 5B, the node on the path connecting the first switch SW1 and the current detecting resistor R1 is a grounding terminal GND. In other words, a lighting auxiliary circuit 10*e* in FIG. 5B has a substantially identical structure to that of the lighting auxiliary circuit 10*b* in FIG. 3B.

By the discharge lamp lighting circuit 100*e* in FIG. 5B, similarly, it is possible to detect grounding of a second DC/DC converter CONV2.

In the case in which the grounding is detected by a different approach from the approach described above or a whole system is not adversely influenced by a malfunction of the detection of the grounding, it is apparent that the lighting auxiliary circuits 10*a* and 10*b* in FIGS. 3A and 3B can be used.

Second Embodiment

In the first embodiment, there has been described the technique for alternately operating the two DC/DC converters provided on the both terminals of the discharge lamp 4 to carry out the AC lighting. In a second embodiment, the AC lighting is carried out by using a single DC/DC converter and a switching circuit (an H bridge circuit).

Figure 6:
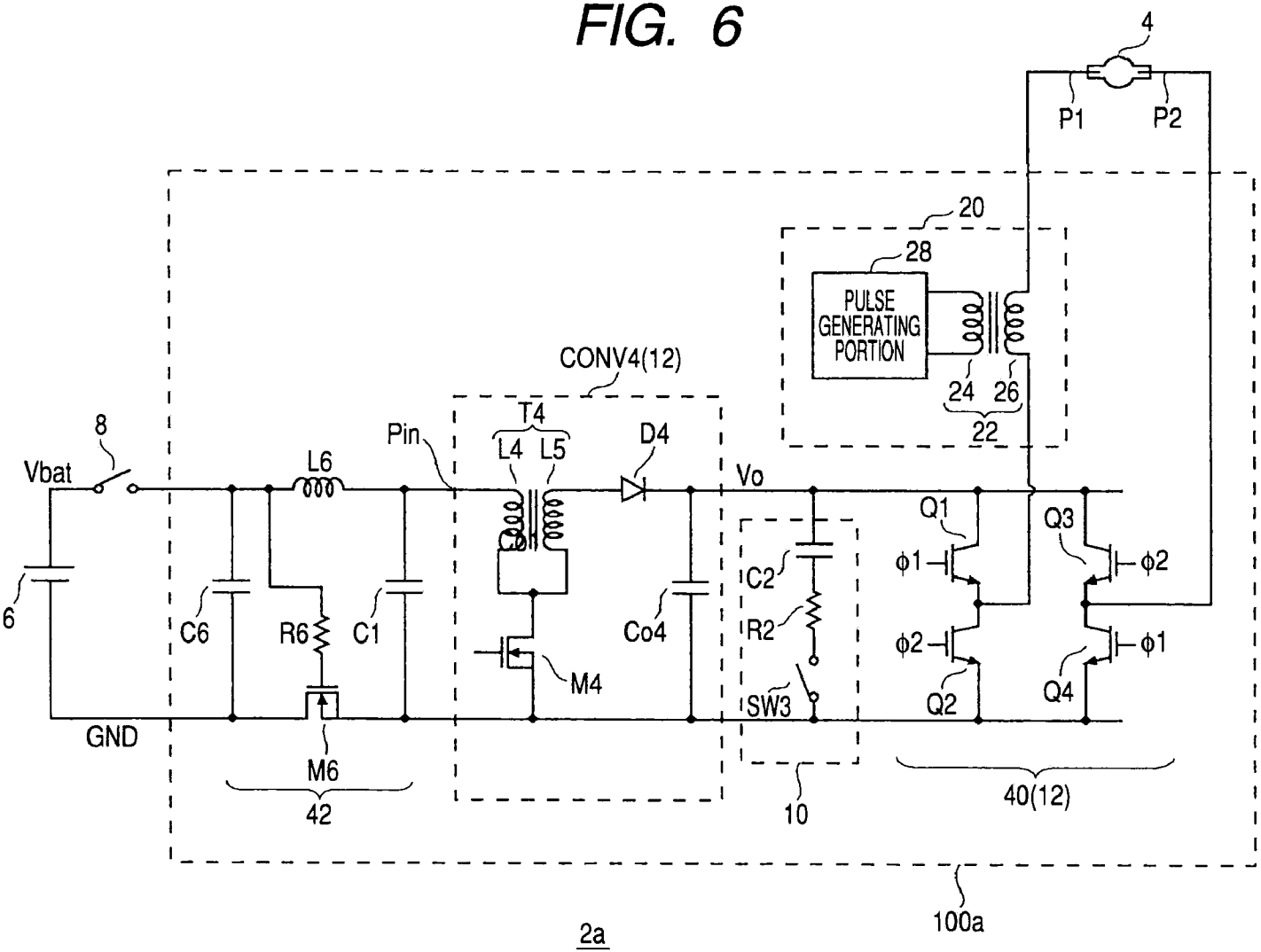
FIG. 6 is a circuit diagram showing an example of a structure of a lighting device for a vehicle according to a second embodiment.

FIG. 6 is a circuit diagram showing a structure of a lighting device 2*a* for a vehicle according to the second embodiment. Description of common structures to FIG. 1 will be omitted and only different parts will be explained.

A discharge lamp lighting circuit 100*a* includes a DC/DC converter CONV4, an auxiliary lighting circuit 10, a starter circuit 20, an H bridge circuit 40 and an input circuit 42.

The input circuit 42 includes an input inductor L6, input capacitors C1 and C6, a resistor R6, and an input switch M6. The input capacitor C6 is provided in parallel with a battery 6 and smoothes a battery voltage Vbat.

The input inductor L6 is provided in series to a power switch 8 between the battery 6 and an input terminal Pin of the DC/DC converter CONV4. The input capacitor C6 and the input switch M6 are provided in series between the input terminal Pin and a ground terminal GND. The resistor R6 is provided between a gate of the input switch M6 and one of terminals of the input capacitor C1. The input circuit 42 blocks a leakage of a noise made in the DC/DC converter CONV4 to the battery 6 side. Moreover, the input switch M6 and the resistor R6 are provided for protecting the circuit and have a function for blocking a current when the battery 6 is connected in a reverse polarity.

The DC/DC converter CONV4 raises the battery voltage Vbat. The DC/DC converter CONV4 includes a transformer T4, a rectifier diode D4, an output capacitor Co4 and a switching unit M4. One of terminals of a primary coil L4 of the transformer T4 and one of terminals of a secondary coil L5 thereof are connected in common to a drain of the switching unit M4 (MOSFET). By switching the switching unit M4, the battery voltage Vbat is raised. A duty ratio of ON/OFF of the switching unit M4 is controlled in the same manner as in the first embodiment. An output voltage Vo thus raised is supplied to the H bridge circuit 40 in a subsequent stage.

The H bridge circuit 40 includes high side switches Q1 and Q3 and low side switches Q2 and Q4 in an IGBT. By an alternate repetition of a first state $\phi 1$ in which a pair of the switches Q1 and Q4 is turned ON and a second state $\phi 2$ in which a pair of the switches Q2 and Q3 is turned ON, an AC driving voltage is supplied to the discharge lamp 4. In other words, the DC/DC converter CONV4 and the H bridge circuit 40 function as a driving voltage generating portion 12.

The auxiliary lighting circuit 10 and the starter circuit 20 are the same as those in the first embodiment. The auxiliary lighting circuit 10 has any of structures shown in FIGS. 1, 3A and 3B.

The discharge lamp lighting circuit 100*a* in FIG. 6 can provide the following advantages.

(4) A switch SW3 of the auxiliary lighting circuit 10 is turned OFF when the discharge lamp 4 is tuned ON, and an auxiliary lighting capacitor C2 is disconnected from a driving path of the discharge lamp 4 while the discharge lamp 4 is turned ON. In the same manner as in the first embodiment, accordingly, a back electromotive force generated in a secondary coil 26 in a re-ignition is not absorbed into the auxiliary lighting capacitor C2. Therefore, it is possible to prevent the discharge lamp 4 from causing a lighting failure.

(5) Also in the second embodiment, the auxiliary lighting capacitor C2 does not influence a lighting operation of the discharge lamp 4 in the same manner as in the first embodiment. Therefore, a capacitance value can be designed in consideration of only an original function of the auxiliary lighting circuit 10. Consequently, it is possible to utilize a capacitor having a larger capacitor than that in the conventional art. Thus, it is possible to reliably carry out an arc growth.

The foregoing embodiments are illustrative and it is to be understood by the skilled in the art that various variants can be made in a combination of each component and each processing process and are also included in the range of the invention.

Although the description has been given to the case in which the positive driving voltages Vo1 and Vo2 are generated and applied to the discharge lamp 4 (which is referred to as positive electrode lighting) in the first embodiment, it is also possible to generate negative driving voltages Vo1 and Vo2, thereby driving the discharge lamp 4 (which is referred to as negative electrode lighting). In this case, directions of the first rectifier diode D1 and the second rectifier diode D2 in FIG. 1 are inverted.

Also in the case in which the negative electrode lighting is carried out, either of the auxiliary lighting circuits 10*a* and 10*b* in FIGS. 3A and 3B can be provided. It is necessary to dispose the diode D3 in FIGS. 3A and 3B in such a direction that either of the terminal P1 of the discharge lamp 4 and the ground terminal GND which has a lower electric potential is set to be the anode. In the case in which the negative electrode lighting is carried out, the terminal P1 side of the discharge lamp 4 has a lower electric potential. Therefore, the diode D3 is to be inverted in such a manner that the anode is set onto the terminal P1 side of the discharge lamp 4.

Also in the second embodiment, it is also possible to invert a direction of the rectifier diode D4 in FIG. 6, thereby carrying out the negative electrode lighting. In this case, also when either of the auxiliary lighting circuits 10*a* and 10*b* in FIGS. 3A and 3B is provided, it is preferable to invert the direction of the diode D3.

Although the description has been given by taking the lighting device for a vehicle as an example in the embodiments, the use of the invention is not restricted thereto but the invention can be widely applied to a discharge lamp lighting circuit including an auxiliary lighting circuit.

Other implementations are within the scope of the claims.

What is claimed is:

1. A discharge lamp lighting circuit comprising:

a driving voltage generating portion arranged to supply an AC driving voltage to a discharge lamp to be a driving target; and an auxiliary lighting circuit on a terminal side of the discharge lamp, wherein the auxiliary lighting circuit includes:

a capacitor, a switch unit and a resistance element in series between the terminal side of the discharge lamp and a fixed voltage terminal;

a control portion for controlling a conducting state of the switch unit; and a diode having an anode disposed on the fixed voltage terminal side in parallel with the switch unit;

wherein the control portion is arranged to turn ON the switch unit when a lamp voltage to be applied to the terminal of the discharge lamp is higher than a predetermined threshold voltage, and to turn OFF the switch unit when the lamp voltage is lower than the threshold voltage, and wherein the control portion controls the switch unit to turn on after the discharge lamp lighting circuit is turned on, but before the discharge lamp turns on, and wherein the control portion controls the switch unit to turn off after the discharge the discharge lamp turns on.

2. The discharge lamp lighting circuit according to claim 1, wherein the control portion is arranged to turn ON the switch unit before a passage of a predetermined time since a start of a driving operation of the discharge lamp and to turn OFF the switch unit after the passage of the predetermined time.

3. A discharge lamp lighting circuit comprising:

a driving voltage generating portion arranged to supply an AC driving voltage to a discharge lamp to be a driving target; and an auxiliary lighting circuit on a terminal side of the discharge lamp, wherein the auxiliary lighting circuit includes:

a capacitor, a switch unit and a resistance element in series between the terminal side of the discharge lamp and a fixed voltage terminal; and a control portion for controlling a conducting state of the switch unit; and wherein the driving voltage generating portion includes:

a first DC/DC converter arranged to supply a first driving voltage to a first terminal of the discharge lamp;

a second DC/DC converter arranged to supply a second driving voltage to a second terminal of the discharge lamp;

a first switch on the terminal side of the discharge lamp and arranged to electrically conduct the terminal of the discharge lamp and the fixed voltage terminal in an ON state; and a second switch on the other terminal side of the discharge lamp and arranged to electrically conduct the other terminal of the discharge lamp and the fixed voltage terminal in an ON state, wherein the first DC/DC converter and the second DC/DC converter are arranged to complementarily repeat an active state and a non-active state in a predetermined cycle, wherein the first switch is turned ON when the second DC/DC converter is active, and the second switch is turned ON when the first DC/DC converter is active.

4. A discharge lamp lighting circuit comprising:

a driving voltage generating portion arranged to supply an AC driving voltage to a discharge lamp to be a driving target; and an auxiliary lighting circuit on a terminal side of the discharge lamp, wherein the auxiliary lighting circuit includes:

a capacitor, a switch unit and a resistance element in series between the terminal side of the discharge lamp and a fixed voltage terminal;

a control portion for controlling a conducting state of the switch unit; and a diode having an anode disposed on the fixed voltage terminal side on a parallel path with the switch unit; and wherein the driving voltage generating portion includes:

a first DC/DC converter arranged to supply a first driving voltage to a first terminal of the discharge lamp;

a second DC/DC converter arranged to supply a second driving voltage to a second terminal of the discharge lamp;

a first switch on one of the terminal sides of the discharge lamp and arranged to electrically conduct one of the terminals of the discharge lamp and the fixed voltage terminal in an ON state;

a second switch provided on the other terminal side of the discharge lamp and arranged to electrically conduct the other terminal of the discharge lamp and the fixed voltage terminal; and at least one current detecting resistor on a path of a current flowing to the discharge lamp when the first switch is ON and a path of a current flowing to the discharge lamp when the second switch is ON, wherein the first DC/DC converter and the second DC/DC converter are arranged to complementarily repeat an active state and a non-active state at a predetermined frequency, wherein the first switch is turned ON when the second DC/DC converter is active, the second switch is turned ON when the first DC/DC converter is active, and the first DC/DC converter and the second DC/DC converter are controlled based on a voltage drop of the at least one current detecting resistor, and wherein the at least one current detecting resistor is disposed in a place which is not included in a loop formed by the first switch and the diode.

5. The discharge lamp lighting circuit according to claim 4, wherein a terminal on the fixed voltage terminal side of the first switch and a terminal on the fixed voltage terminal side of the second switch are connected in common, the current detecting resistor is between the terminals of the first switch and the second switch which are connected in common and the fixed voltage terminal, and the anode of the diode is connected to a path connecting the first switch and the current detecting resistor.

6. The discharge lamp lighting circuit according to claim 4, wherein the current detecting resistor is between a terminal on the fixed voltage terminal side of the first switch and a terminal on the fixed voltage terminal side of the second switch, and the anode of the diode is connected to a path connecting the first switch and the current detecting resistor.

7. The discharge lamp lighting circuit according to claim 4, wherein two current detecting resistors are provided for the at least one current detecting resistor, a first one of the current detecting resistors is between the first switch and the fixed voltage terminal, a second one of the current detecting resistors is between the second switch and the fixed voltage terminal, and the anode of the diode is connected to a path connecting the first switch and the first current detecting resistor.

8. The discharge lamp lighting circuit of claim 1 wherein the control portion is arranged to turn ON the switch unit when a lamp current flowing to the discharge lamp is smaller than a predetermined threshold current, and to turn OFF the switch unit when the lamp current is larger than the threshold current.

* * * * *